US005158051A

United States Patent [19]

Wada et al.

[11] Patent Number: 5,158,051

[45] Date of Patent: * Oct. 27, 1992

[54] FUEL SUPPLY SYSTEM FOR ENGINE

[75] Inventors: Minoru Wada, Nishitamagun; Tetsuo Yamagishi, Musashimurayama; Isao Morooka, Oume, all of Japan

[73] Assignee: Komatsu Zenoah Kabushiki Kaisha, Tokyo, Japan

[ * ] Notice: The portion of the term of this patent subsequent to Sep. 17, 2008 has been disclaimed.

[21] Appl. No.: 697,194

[22] Filed: May 8, 1991

Related U.S. Application Data

[63] Continuation-in-part of Ser. No. 330,081, Mar. 6, 1989, Pat. No. 5,048,477.

[51] Int. Cl.[5] ..... F02M 1/10

[52] U.S. Cl. ..... 123/179.15; 123/179.18

[58] Field of Search ..... 123/180 P, 180 T, 180 E, 123/187.5 R, 179 G

[56] References Cited

U.S. PATENT DOCUMENTS

| | | | |
|---|---|---|---|
| 3,614,945 | 10/1971 | Schlagmüller et al. | 123/179 G |
| 3,704,702 | 12/1972 | Aono | 123/179 G |
| 4,216,175 | 8/1980 | Schauer | 123/179 G |
| 4,554,896 | 11/1985 | Sougawa | 123/187.5 R |
| 5,048,477 | 9/1991 | Wada et al. | 123/180 P |

FOREIGN PATENT DOCUMENTS

| | | |
|---|---|---|
| 0306856 | 3/1989 | European Pat. Off. . |
| 0306857 | 3/1989 | European Pat. Off. . |
| 62-35047 | 2/1987 | Japan . |

*Primary Examiner*—Andrew M. Dolinar
*Attorney, Agent, or Firm*—Weiser & Stapler

[57] ABSTRACT

Disclosed is a fuel supply system for an internal combustion engine having a fuel tank, a combustion chamber defined in an engine cylinder, and an air intake passage communicating with the combustion chamber. The fuel supply system comprises a main fuel passage communicating the fuel tank and the air intake passage, first supply mechanism provided on the main fuel passage for supplying main fuel from the fuel tank to the air intake passage responsive to the cranking of the engine a starting fuel passage defined separate from the main fuel passage and communicating with the air intake passage and the main fuel passage, and second supply mechanism provided on the starting fuel passage for supplying a predetermined amount of starting fuel into the air intake passage, in addition to the supply of main fuel, responsive to the temperature of the engine cylinder upon starting of the engine. The main fuel passage and the starting fuel passage communicate with the venturi portion of the air intake passage so that the supply of both main fuel and starting fuel into the intake air passage is performed at the venturi portion.

12 Claims, 4 Drawing Sheets

FUEL SUPPLY SYSTEM FOR ENGINE

BACKGROUND OF THE INVENTION

This application is a continuation in part application from U.S. patent application No. 07/330,081 filed on Mar. 6, 1989, which corresponds to PCT application No. PCT/JP88/00682 filed on Jul. 6, 1988, and is now U.S. Pat. No. 5,048,477.

FIELD OF THE INVENTION

This invention relates to a fuel supply system for an internal combustion engine, and more specifically to a fuel supply system which is operative during engine start-up to enrich the air/fuel mixture when starting the engine at low temperatures.

DESCRIPTION OF THE PRIOR ART

Paralleling, the technological innovations in electronics, many improvements have been achieved in the field of internal combustion engines in order to produce a well-controlled engine having high efficiency. These improvements have been mainly carried out in the relatively large and complicated field of engines for automobiles and motor cycles. For example, one conventional fuel supply system for an engine, as shown in U.S. Pat. No. 4,676,204 filed on Dec. 24, 1985, is controlled by means of many devices such as a CPU, a memory, an interface and various detectors. Employment of those devices gives many functions to the engine system and enables precise control of the engine system. However, such a system raises the cost of production and the frequency of trouble, especially electrical trouble. On the other hand, for many kinds of house-hold articles and portable machines, there is recently a growing tendency for various arrangements such as compact or light-weight products to be made to meet the convenience of users. Portable-type working machines such as lawn mowers, blowers and chemical dispersion machines are no exception to this current trend. These portable-type machines are required to be more compact and simple to use. Accordingly, compaction and miniatuarization of the engine system is highly important, especially for portable-type working machines.

SUMMARY OF THE INVENTION

With the above requirements in mind, it is the primary object of the present invention to provide a novel fuel supply system which is simple and effectively usable, especially for small, portable-type engines.

In order to achieve the above-mentioned object, a fuel supply system according to the present invention comprises: a main fuel passage communicating the fuel tank and the air intake passage; first supply means provided on the main fuel passage for supplying main fuel from the fuel tank to the air intake passage responsive to the cranking of the engine; a starting fuel passage defined separate from the main fuel passage and communicating with the air intake passage and the main fuel passage; and second supply means provided on the starting fuel passage for supplying a predetermined amount of starting fuel into the air intake passage, in addition to the supply of main fuel, responsive to the temperature of the engine cylinder upon starting of the engine, wherein the air intake passage has a venturi portion, and the main fuel passage and the starting fuel passage communicate with the venturi portion of the air intake passage so that the supply of both main fuel and starting fuel into the intake air passage is performed at the venturi portion.

According to the above construction, the fuel supplied into the air intake passage can be easily atomized at the venturi portion. Moreover, the above construction can contribute to compaction of the fuel supply system for the engine.

BRIEF DESCRIPTION OF THE DRAWINGS

The features and advantages of the fuel supply system according to the present invention over conventional fuel supply systems will be more clearly understood from the following description of the preferred embodiments of the present invention taken in conjunction with the accompanying drawings in which the same reference numerals designate the same or similar elements or sections throughout the figures thereof, and in which.

DETAILED DESCRIPTION OF THE PREFERRED EMBODIMENTS

Figure 1:
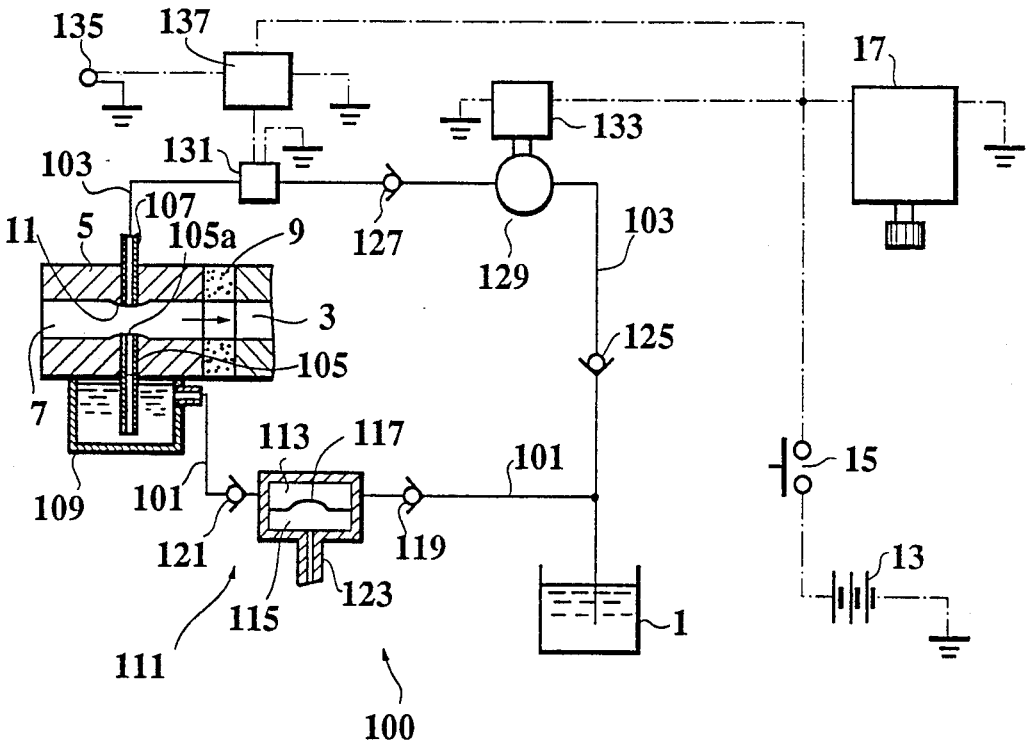
FIG. 1 is a schematic view showing a first embodiment of a fuel supply system according to the present invention.

Referring now to the drawings, preferred embodiments of the fuel supply system according to the present invention will be described. It should be noted that in the following description of the embodiments, the same reference numerals denote the same components or structures.

FIG. 1 shows a first embodiment of a fuel supply system for an engine according to the present invention. In this embodiment, a fuel supply system 100 is applied to a small, two-stroke type engine which is usable for a hand-operated working machine such as a portable-type lawn mower or blower. As shown in the drawing, the engine has a fuel tank 1, an air suction port 3 extending to a combustion chamber defined in an engine cylinder (not shown), and a carburetor 5 having an air intake passage 7 in communication with the air suction port 3. As shown in the drawing, the fuel supply system 100 of the present invention has a main fuel passage 101 for main fuel supply and a starting fuel passage 103 for starting fuel supply through which fuel is supplied from the fuel tank 1 into the air intake passage 7.

More specifically, the carburetor 5 is mounted, by bolts, for example, on the air suction port 3 via a heat insulator 9. The carburetor 5 has the air intake passage 7 communicating the open air and the air suction port 3 across a relatively short distance.

The air intake passage 7 is formed with a venturi portion 11 where the air intake passage 7 is narrowed. A main nozzle 105 for feeding main fuel and a starting fuel nozzle 107 for feeding starting fuel are separately provided on the venturi portion 11 of the carburetor 5. Both main fuel and starting fuel, accordingly, are discharged at the venturi portion 11 into the air intake passage 7. To prevent overdischarging, the main nozzle 105 has an appropriate size nozzle port **105*a* at a tip portion thereof to supply main fuel at an appropriate fuel/air mixing rate for normal running of the engine. A fuel chamber 109 is provided below the venturi portion 11 of the air intake passage 7, and the main nozzle 105 extends through the venturi portion 11 into the fuel chamber 109**.

The main fuel passage 101 is provided with a diaphragm pump 111 which has a pumping chamber 113 and a pressure chamber 115 separated by a diaphragm 117 inside the diaphragm pump 111. The pumping chamber 113 is in communication with the main fuel passage 101 and two check valves 119, 121 are provided along the main fuel passage 101 in order to allow the fuel to flow only in the direction from the fuel tank 1 to the fuel chamber 109 through the pumping chamber 113. The pressure chamber is in communication with a crankcase (not shown) of the engine through a communication tube 123 so that the diaphragm 117 may pump in response to the pressure change in the crankcase in accordance with the cranking of the engine.

According to the above construction, main fuel is sucked from the fuel tank 1 via the check valves 119, 121 and the diaphragm pump 111 into the fuel chamber 109 by the cranking of the engine.

On the other hand, the starting fuel passage 103, diverging from the main fuel passage 101, extends to the starting fuel nozzle 107. Check valves 125, 127, a starting fuel pump 129 and a solenoid valve 131 are provided along the starting fuel passage 103. The starting fuel pump 129 is electrically connected via a control device 133 for controlling the starting fuel pump 129 to a battery 13 with a push-button type starting switch 15. Further, a starter motor 17 is electrically connected to the battery 13 parallel with the starting fuel pump 129. Accordingly, the starting fuel pump 129 is operated concurrently with the starter motor 17 upon starting of the engine. A solenoid coil (not shown) of the solenoid valve 131 is electrically connected through a control device 137 to a temperature sensor 135 which is set on the engine for detecting the temperature of the engine cylinder in order to give signalized temperature information, and the solenoid valve 131 is controlled by the control device 137 in accordance with the signalized temperature information obtained from the temperature sensor 135 so as to be closed or regulated according to the temperature level of the engine cylinder. The temperature sensor 135 is electrically connected to the battery 13 via the starting switch 15.

In operation, upon starting of the engine, an operator presses the push button to turn on the starting switch 15, which causes the starter motor 17 and the starting fuel pump 129 to be driven. The engine is cranked by the starter motor 17, and the diaphragm pump 111 delivers main fuel from the fuel tank 1 to the fuel chamber 109 in response to the cranking of the engine. The fuel in the fuel chamber 109 is sucked into the air intake passage 7, by negative pressure in the air intake passage 7 produced by the cranking of the engine, and is concurrently pushed out of the fuel chamber 109 by pumping of the diaphragm pump 111. On the other hand, the temperature sensor 135 is operated to detect the cylinder temperature, and if the engine cylinder is cool, the solenoid valve 131 is operated to be opened, which cause starting fuel to be delivered by the starting pump through the starting fuel passage 103 to be supplied into the air intake passage 7. After starting the engine, the operator release the push button to turn off the starting switch 15. Then the starter motor 17 and the starting fuel pump 129 stop and the solenoid valve 131 is closed. As a result, the supply of starting fuel is stopped. In the case where the cylinder is warm upon starting of the engine, the solenoid valve 131 is regulated to be closed so that any unnecessary supply of starting fuel is prevented.

In the above construction, the fuel supplied into the air intake passage 7 can be easily atomized at the venturi portion 11, because the flow speed of the intake air is highest at the venturi portion 11 where the air intake passage 7 is choked. Therefore, main fuel and starting fuel supplied to the present invention is efficiently mixed with the intake air in the air intake passage 7. Moreover, in accordance with the location of the main nozzle 105 and starting fuel nozzle 107 on the venturi portion 11, the fuel supply system of the present invention can employ a relatively short distance for the air intake passage 7. Thus, the above construction can contribute to compaction of the fuel supply system for the engine.

The starting fuel passage 103 in the above embodiment can be communicated with the fuel chamber 109, instead of the fuel tank 1, as a fuel source in order to shorten the distance between the fuel source and the starting fuel nozzle 107.

Figure 2:
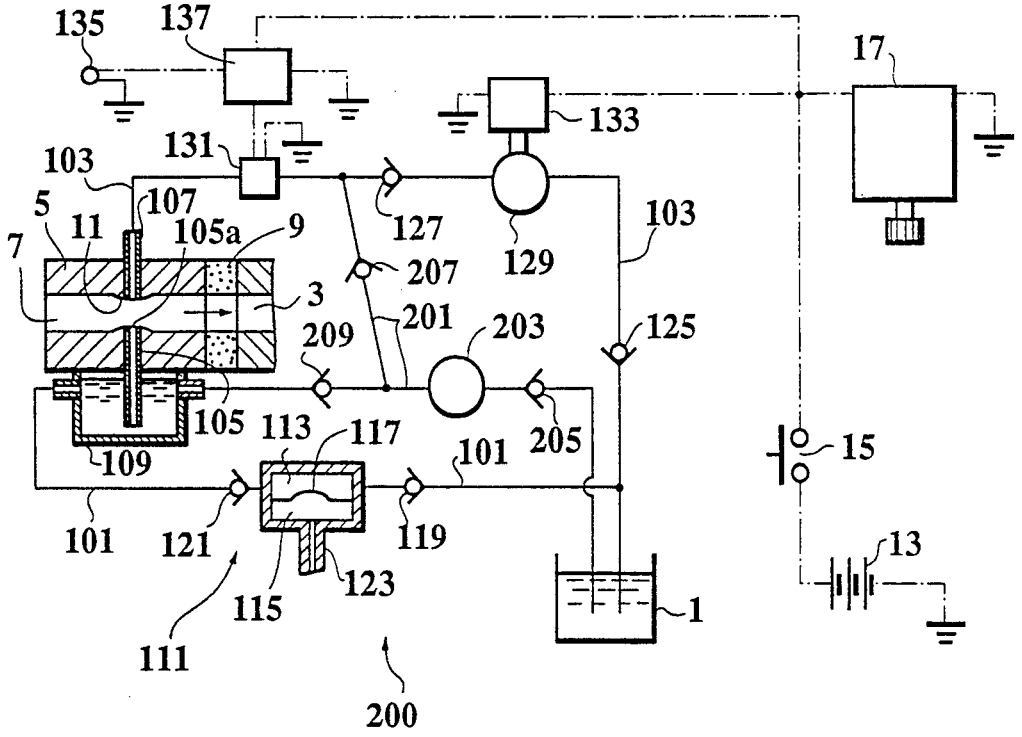
FIG. 2 is a schematic view showing a second embodiment of the fuel supply system.

FIG. 2 illustrates a second embodiment of the present invention. As shown in FIG. 2, the fuel supply system 200 in this embodiment further comprises an overflow passage 201 with a priming pump 203 for priming the fuel supply system in order to prevent ignition under conditions when there is no fuel supply in the air intake passage 7. The overflow passage 201 is in communication with both the fuel chamber 109 on the main fuel passage 101 and the starting fuel passage 103 so that the fuel in both passages is allowed to flow into the overflow passage 201 to return back to the fuel tank 1. Along the overflow passage 201, there are provided check valves 205, 207, 209 in order to allow the fuel to flow only in the direction from the fuel chamber 109 and the starting fuel passage 103 to the fuel tank 1.

According to the above construction, in advance of starting of the engine, the operator actuates the priming pump 203 appropriately. The priming pump 203 sucks fuel through both the main fuel passage 101 and the starting fuel passage 103 from the fuel tank 1. The fuel delivered through the main fuel passage 101 fills the fuel chamber 109, and then overflows into the overflow passage 201 to return to the fuel tank 1. Further, the fuel through the starting fuel passage 103 is delivered into the overflow passage 201 and returns to the fuel tank 1. At the next stage, the operator stops the actuation of the priming pump and turns on the starting switch 15, thereby operating the starter motor 17 and cranking the engine. Main fuel in the fuel chamber 109 is sucked immediately by the negative pressure in the air intake passage 7 and is concurrently pushed out by the pumping of the diaphragm pump 111. The temperature sensor 135 is operated, and if the detected temperature of the engine cylinder is low, the solenoid valve 131 is opened, so that starting fuel is delivered at once by the starting pump and is sucked by the negative pressure produced in the air intake passage 7. If the engine cylinder is warm, the solenoid valve 131 is kept closed, thereby preventing the starting fuel from being discharged.

In the second embodiment, pumps of various types can be employed as the priming pump 203, however, a hand-operated pump, such as a bulb device made of an elastic material, is preferable for small, portable-type engines, because it has a simple structure and contributes to compaction of the engine as a whole.

In the above construction, upon priming the fuel passages, the fuel overflowing the main fuel passage 101 and the starting fuel passage 103 can circulate by means of the overflow passage 201 between the fuel tank 1 and the neighbourhood of the air intake passage 7 without being blocked, thus allowing the fuel to flow smoothly and unhindered through the passages. As a result, the pumping devices are relieved from bearing excess loads, and especially in the case where an elastic bulb is employed as the priming pump 203, the operator can easily operate the priming pump 203 by hand. Moreover, if the priming pump 203 is operated to the point where the capacity of the fuel chamber 109 is exceeded, the extra fuel will simply return back to the fuel tank 1 without being forced out from the fuel nozzles into the air intake passage 7. Therefore, it can prevent the occurrence of ignition plugs of the engine being wetted with a large amount of extra fuel before sparking.

Figure 3:
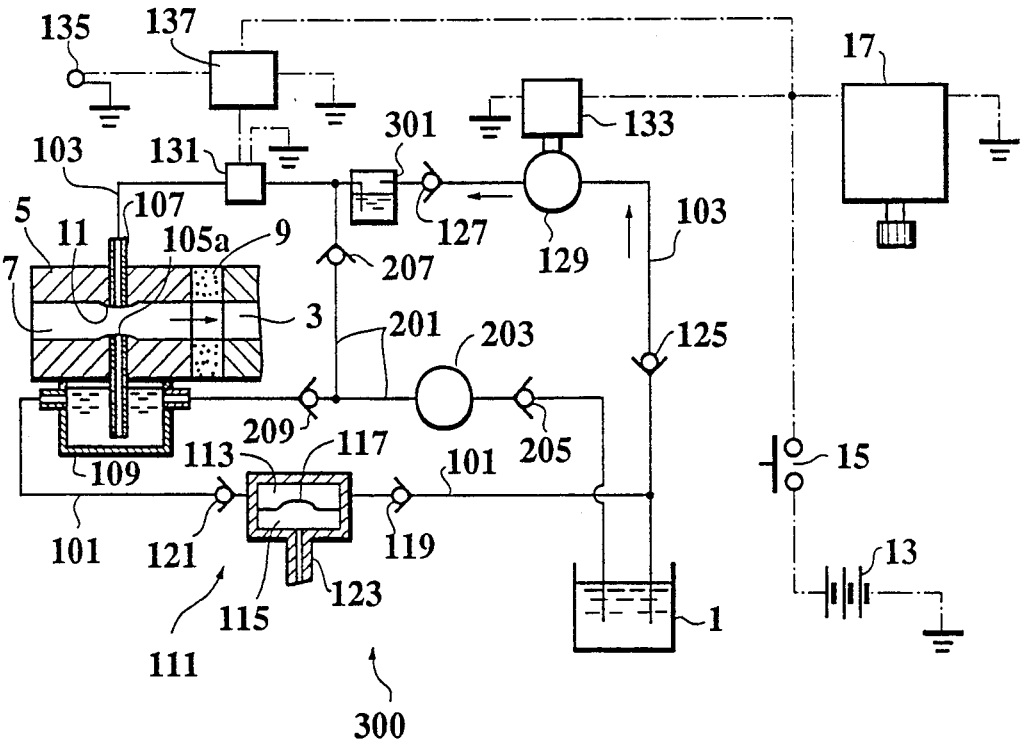
FIG. 3 is a schematic view showing a third embodiment of the fuel supply system.

FIG. 3 illustrates a third embodiment of a fuel supply system 300 according to the present invention. In this embodiment, a fuel reservoir 301 is additionally provided along the starting fuel passage 103. According to this construction, a constant amount of starting fuel is reserved in the fuel reservoir 301 by the priming operation. Consequently, it is easy to control the amount of starting fuel fed when the engine is started. In the third embodiment, the starting pump can be omitted from the fuel supply system 300, and in this case, starting fuel can be delivered sufficiently into the air intake passage 7 by means of only the negative pressure in the air intake passage 7.

Figure 4:
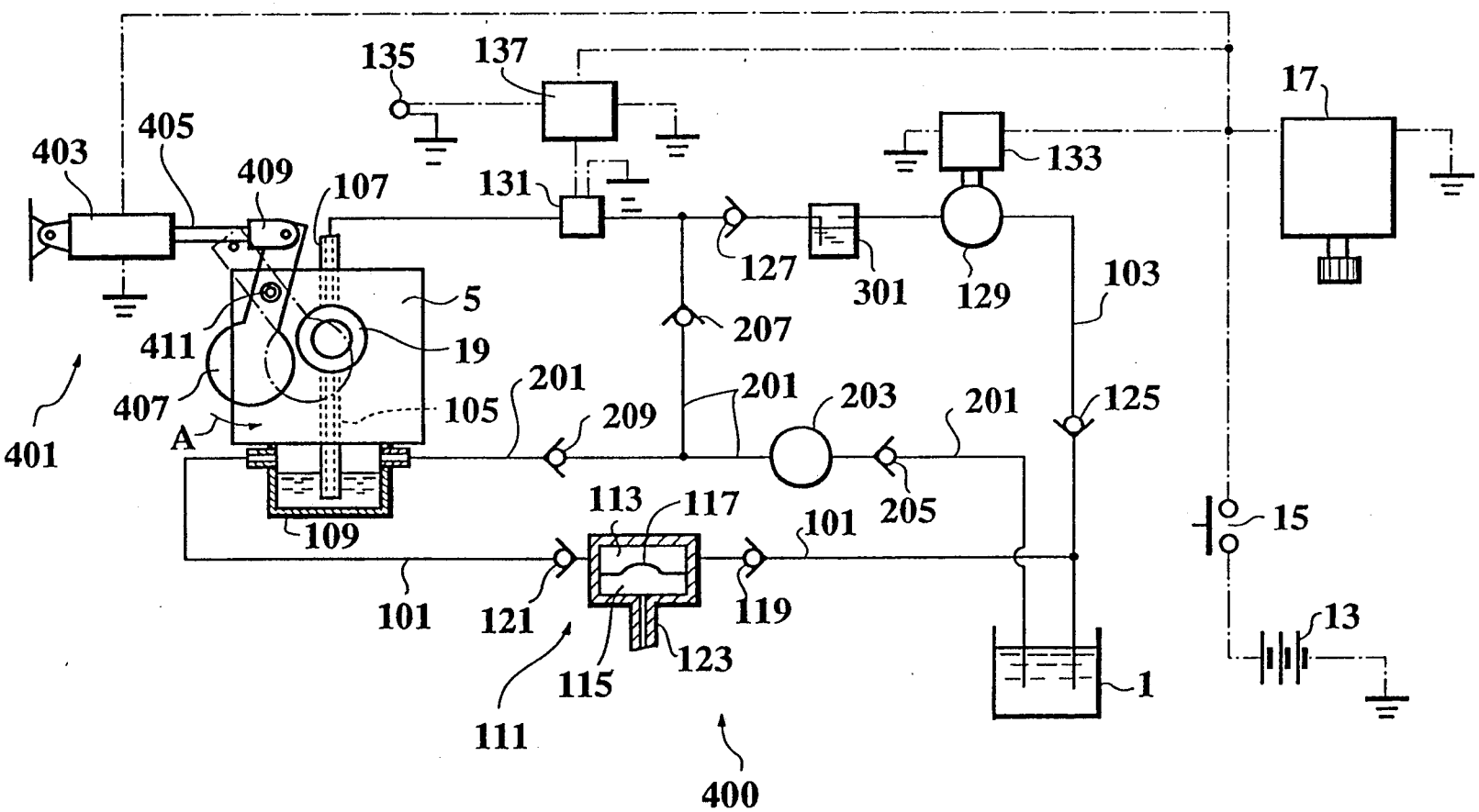
FIG. 4 is a schematic view showing a fourth embodiment in combination with a choke device.

FIG. 4 is a fourth embodiment in which a fuel supply system 400 further comprises an automatic choke device 401 operated by means of a solenoid device 403 having an armature 405. In this embodiment, the solenoid device 403 is electrically connected to the battery 13 via the starting switch 15 so that it is operated simultaneously when the starter motor 17 is driven. The armature 405 of the solenoid device 403 is connected to one end of a choke valve 407 by a connecting member. The choke valve 407 is mounted on the carburetor 5 beside an intake port 19 of the air intake passage 7 pivotably with respect to a shaft, so that the choke valve 407 is pivoted parallel to a plane including the intake port 19 in order to cover the intake port 19. According to this construction, when the starting switch 15 is turned on, the solenoid device 403 pulls the connected end of the choke valve 407 with the armature 405 and the connecting member, and the choke valve 407 is pivoted toward the direction shown by the arrow A in FIG. 4 to close the intake port 19. At the same time, the same operation as described in the third embodiment is achieved in the supply of main fuel and starting fuel.

This embodiment is constructed by combining the choke device 401 with the fuel supply system 300 of the third embodiment according to the present invention. However, it is of course possible to combine the choke device 401 with the first and second embodiments of the present invention.

In the above-mentioned embodiments according to the present invention, it is of course possible to utilize a recoil starter instead of the starter motor. In this case, the starting fuel pump can be provided so as to be interlocked with the recoil starter in a mechanical or electrical manner.

Further, it is also possible to connect the solenoid valve for controlling the supply of starting fuel to a revolution counter for the engine, thereby allowing the solenoid valve to be controlled in conjunction with engine speed.

It must be understood that the invention is in no way limited to the above embodiments and that many changes may be brought about therein without departing from the scope of the invention as defined by the appended claims.

What is claimed is:

1. A fuel supply system for an internal combustion engine having a fuel tank, a combustion chamber defined in an engine cylinder, and an air intake passage communicating with the combustion chamber, comprising:

a main fuel passage communicating the fuel tank and the air intake passage;

first supply means provided on the main fuel passage for supplying main fuel from the fuel tank to the air intake passage responsive to the cranking of the engine;

a starting fuel passage defined separate from the main fuel passage and communicating with the air intake passage and the main fuel passage; and second supply means provided on the starting fuel passage for supplying a predetermined amount of starting fuel into the air intake passage, in addition to the supply of main fuel, responsive to the temperature of the engine cylinder upon starting of the engine, wherein the air intake passage has a venturi portion, and the main fuel passage and the starting fuel passage communicate with the venturi portion of the air intake passage so that the supply of both main fuel and starting fuel into the intake air passage is performed at the venturi portion.

2. The fuel supply system of claim 1, further comprising means for priming the main fuel passage and the starting fuel passage with fuel in advance of the starting of the engine.

3. The fuel supply system of claim 2, wherein the priming means includes means for removing from the main fuel passage and the starting fuel passage any fuel that exceeds a predetermined amount for priming the main fuel passage and the starting fuel passage.

4. The fuel supply system of claim 3, wherein the removing means is an overflow passage communicating with the main fuel passage and the starting fuel passage and extends to the fuel tank for returning excess fuel back to the fuel tank.

5. The fuel supply system of claim 4, wherein the priming means includes a priming pump provided on the overflow passage for forcceably delivering fuel through the main fuel passage and the starting fuel passage to prime the main fuel passage and the starting fuel passage.

6. The fuel supply system of claim 2, wherein the second supply means includes:

means for storing the predetermined amount of starting fuel which is to be supplied into the air intake passage when the second supply means is operated; and means for controlling the supply of starting fuel stored by the storing means into the air intake passage.

7. The fuel supply system of claim 6, wherein the storing means comprises a fuel reservoir which is to be filled with starting fuel.

8. The fuel supply system of claim 7, wherein the second supply means further comprises means for forceably feeding starting fuel from the fuel reservoir into the air intake passage.

9. The fuel supply system of claim 1, further comprising a choke device for automatically choking the air intake passage only during the starting up of the engine.

10. The fuel supply system of claim 1 in which the engine includes a crankcase having an inside pressure which changes in response to cranking of the engine, wherein the first supply means comprises a diaphragm device for delivering fuel from the fuel tank into the air intake passage, the diaphragm device communicating with the crank case so that main fuel flows into and out of the diaphragm device in response to pressure changes in the crank case.

11. The fuel supply system of claim 1, wherein the second supply means includes:

a pump for delivering starting fuel from the fuel tank into the starting fuel passage;

means for detecting the temperature of the engine cylinder; and valve means provided between the pump and the air intake passage for controlling the supply of starting fuel into the air intake passage in accordance with the detected temperature of the cylinder.

12. A fuel supply system for an internal combustion engine having a fuel tank, a combustion chamber defined in an engine cylinder, and an air intake passage communicating with the combustion chamber, comprising:

a fuel circulating passage communicating with the fuel tank for circulating the fuel therethrough;

means for circulating the fuel from the fuel tank through the fuel circulating passage back to the fuel tank;

a main fuel passage communicating with the fuel circulating passage and the air intake passage;

first supply means for supplying main fuel from the fuel tank to the air intake passage responsive to cranking of the engine;

a starting fuel passage defined separate from the main fuel passage and communicating with the air intake passage and the fuel circulating passage; and second supply means for supplying an appropriate amount of starting fuel into the air intake passage, in addition to the supply of main fuel, responsive to the temperature of the engine cylinder upon starting of the engine, wherein the air intake passage has a venturi portion, and the main fuel passage and the starting fuel passage communicate with the venturi portion of the air intake passage so that the supply of both main fuel and starting fuel into the air intake passage is performed at the venturi portion.

* * * * *